United States Patent [19]

Winand

[11] 4,069,114

[45] Jan. 17, 1978

[54] METHOD FOR RECOVERING MANGANESE METAL FROM FERROMANGANESE

[75] Inventor: René Fernand Paul Winand, Rixensart, Belgium

[73] Assignee: Universite Libre de Bruxelles, Brussels, Belgium

[21] Appl. No.: 690,432

[22] Filed: May 27, 1976

[30] Foreign Application Priority Data

May 27, 1975 Belgium ..... 829554

[51] Int. Cl.[2] ..... C25C 3/00

[52] U.S. Cl. ..... 204/64 R

[58] Field of Search ..... 204/64 R; 75/63

[56] References Cited

U.S. PATENT DOCUMENTS

| | | | |
|---|---|---|---|
| 2,302,604 | 11/1942 | Dolbear | 204/64 R |
| 2,452,665 | 11/1948 | Kroll | 75/63 |
| 3,028,233 | 4/1962 | Schaefer et al. | 204/64 R |
| 3,450,524 | 6/1969 | Pascaud et al. | 204/64 R |

*Primary Examiner*—John H. Mack
*Assistant Examiner*—H. A. Feeley

[57] ABSTRACT

A method for recovering manganese metal from ferromanganese is disclosed which comprises:

a. contacting ferromanganese and an iron chloride selected from the group consisting of ferrous chloride and ferric chloride in a molten bath of a metal chloride wherein the metal has a greater chemical affinity for chlorine than iron, to provide a liquid phase containing manganese chloride and a solid phase containing iron precipitate;

b. separating the manganese chloride liquid phase from the iron precipitate solid phase;

c. electrolyzing the manganese chloride liquid phase to provide manganese metal.

8 Claims, 3 Drawing Figures

FIG. 2
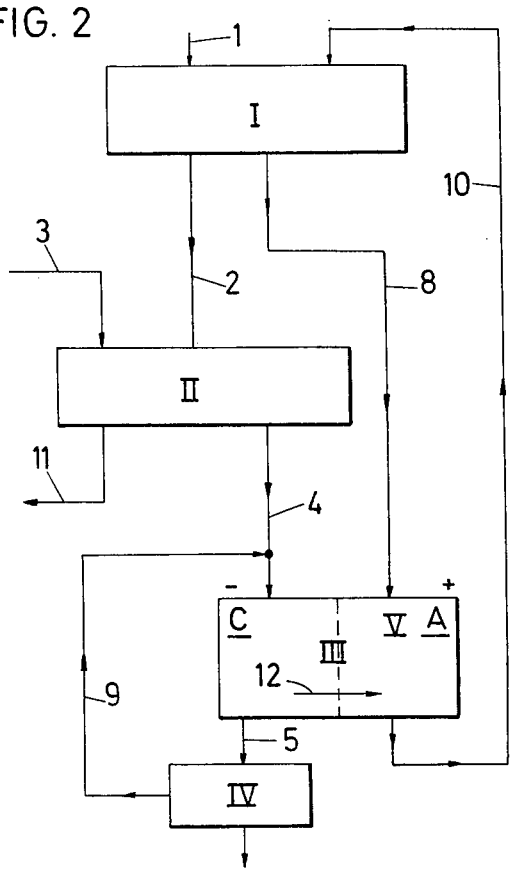
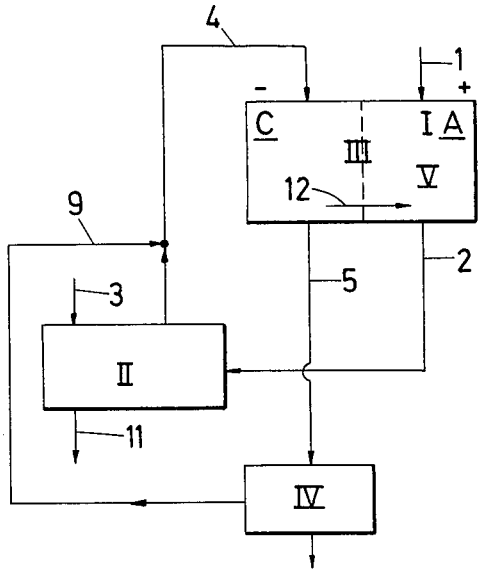
FIG. 3

METHOD FOR RECOVERING MANGANESE METAL FROM FERROMANGANESE

BACKGROUND OF THE INVENTION

1. Field of the Invention

This invention relates to the field of recovering manganese from ferromanganese employing electrolysis.

2. Description of the Prior Art

From U.S. Pat. No. 3,024,116, French Patent 1,463,101 and Belgian Patent 688,998, as well as from the scientific and technical literature illustrated among others, by the following disclosures: A. R. SUCHKOV and N. MICHINAZh. Prikl. Khim. 39(1966) 2157–2162, V. YU. MINDIN and R. I. AGLADZE Elektrokhim Margantsa 4 (1969) 250–63. L. B. BOLDINA, A. R. SUCHKOV and L. A. PARAMONOVA — Sb. Tr. Tsent. Nauch Issled. According to Inst. Chem. Met. 70 (1969)111–8), it is known to produce manganese by refining electrolysis in a molten salt bath, the anode being soluble and formed by more or less carburized ferromanganese.

This method has, however, the drawback that the electrolyte is progressively loaded with impurities in such a way that even if the first amount of metal settling on the cathode is of good quality, this will not be true for the later metal deposit unless the electrolyte is regularly renewed or at least unless said electrolyte is subjected to a very frequent purifying, which operation is however never mentioned in the patents or scientific and technical litterature mentioned above.

SUMMARY OF THE INVENTION

An essential object of the invention is to provide a method allowing one to obviate the referred to above drawback.

For this purpose, the method according to the invention first comprises contacting the ferromanganese and an iron chloride such as ferrous and/or ferric chloride, in molten chloride, causing the formation of a liquid phase containing manganese chloride and a solid phase containing an iron precipitate, and then electrolyzing the liquid phase enriched with manganese chloride and purified from iron chloride, in an electrolysis cell allowing to settle on the cathode thereof, manganese metal.

DESCRIPTION OF THE PREFERRED EMBODIMENTS

A preferred method according to the invention comprises a first contacting of ferromanganese and iron chloride followed by separating the liquid phase and solid phase obtained, and contacting said liquid phase with a second amount of ferromanganese to purify said phase from the iron chloride, and possibly from metals nobler than manganese, and thereafter electrolyzing the thus purified liquid phase so as to settle manganese on the cathode.

In a particular embodiment, the purified liquid phase is fed to the cathode compartment of the electrolysis cell to form therein the electrolyte, and at least that solid phase resulting from the first contacting of ferromanganese and iron chloride is fed to the anode compartment while avoiding any passage of said solid phase towards the cathode compartment, the electrolyte containing regenerated iron chloride formed in the anode compartment being recovered from said compartment to be used again as the iron chloride source in the first contacting of ferromanganese and iron chloride.

In a particular embodiment of the invention, said liquid phase loaded with manganese chloride and purified from iron chloride is fed as electrolyte to the cathode compartment of the electrolysis cell while ferromanganese is fed to the anode compartment while avoiding the passage of solid particles formed by ferromanganese and precipitated iron into the cathode compartment, the electrolyte containing manganese chloride and iron chloride formed in the anode compartment being recovered from the electrolysis cell by means of said compartment and being subjected to purifying by adding a fresh amount of ferromanganese, thus forming a solid phase containing precipitated iron and a liquid phase which comprises the liquid phase that may be fed again as electrolyte into the cathode compartment.

Other details and features of the invention will stand out from the description given below by way of non limitative example and with reference to the accompanying drawings, in which:

FIG. 2 is a block-diagram of the method according to a second embodiment of the invention.

FIG. 3 is a block-diagram of the method according to a third embodiment of the invention.

In the various figures the same reference numerals pertain to similar elements.

Figure 1:
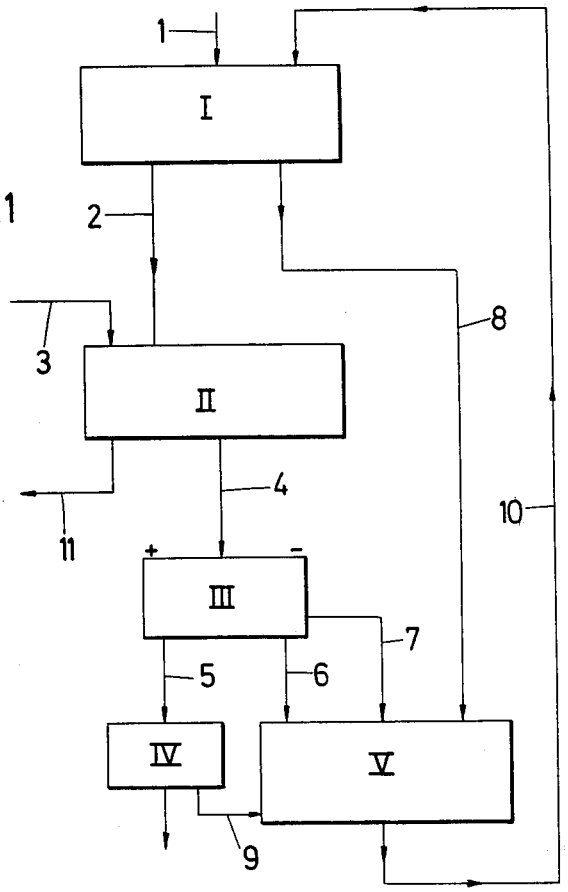
FIG. 1 is a block-diagram of the method according to a first embodiment of the invention.

Generally, the method for recovering manganese metal from ferromanganese by electrolysis in a molten salt bath according to the invention comprises at least one stage during which ferromanganese and an iron chloride such as ferrous and/or ferric chloride are contacted in molten chlorides, notably alkaline and/or alkaline-earth metal chlorides, so as to obtain an electrolyte loaded with manganese chloride and substantially free from iron chloride, in such a way as to be suitable nearly as it stands for elaborating manganese by igneous electrolysis during another stage where said electrolyte is then fed to an electrolysis cell for settling manganese metal on the cathode.

According to the invention, it has indeed been noticed that the contacting of ferromanganese and iron chloride in molten salts allows one to generate thermodynamic and kinetic conditions which are very suitable industrially for forming an iron precipitate and manganese chloride according to the following chemical reaction:

$$[Mn]_{Fe} + Fe^{++} \rightarrow Mn^{++} + Fe$$

$$3\,[Mn]_{Fe} + 2Fe^{+++} \rightarrow 3Mn^{++} + 2Fe$$

In the case where the method for recovering manganese according to the invention would comprise but one step of contacting ferromanganese and iron chloride, said step could be considered as a purifying step for a molten salt bath loaded with manganese chloride and iron chloride by means of which, due to the addition of an excess ferromanganese, the iron chloride is removed according to one of the above reactions.

With this purifying, it is possible to remove metals nobler than manganese which could possibly be present in the molten salt bath.

FIG. 1 relates to a block-diagram for a first embodiment of the method according to the invention that comprises two succeeding steps of contacting ferromanganese and iron chloride.

Specifically, this particular embodiment of the method comprises chlorinating in a first step I, in a selective way, the manganese contained in ferromanganese by means of ferrous and/or ferric chloride in a molten bath of alkaline and/or alkaline-earth metals which are so selected as to obtain a melting point lower than 700° C and preferably lower than 600° C, subjecting in a second step II said molten salt bath containing the manganese as manganous chloride to a purifying operation by means of a second selective chlorinating of the manganese contained in an excess of ferromanganese so as to remove any excess ferrous and/or ferric chloride and metals nobler than the manganese possibly present in the bath, subjecting said purified bath in a third step III to an electrolysis by means of which manganese is settled on the cathode and chlorine is released at the anode, re-melting in a fourth step IV, the manganese settled on the cathode to obtain same in massive form, and finally in a fifth step V contacting the chlorine released at the anode with the iron precipitated in metal form during the first step and possibly the second step of chlorinating so as to regenerate the ferrous and/or ferric chloride.

Arrow 1 shows the feeding of crushed ferromanganese in step I of the method.

Arrow 2 shows the passage of the mixture of molten chlorides containing the manganese chloride and the excess ferrous and/or ferric chloride to the purifying step II during which an excess of crushed ferromanganese shown by arrow 3 is added.

From this purifying step the thus-purified molten chlorides pass, as shown by arrow 4, to an electrolysis cell of step III where the manganese settles on the cathode and goes to step IV as shown by arrow 5, the chlorine released at the anode as well as the manganese-poor electrolyte being contacted in step V with spent ferromanganese and precipitated iron from step I as shown in sequence by arrows 6, 7 and 8, so as to regenerate the iron chloride.

The spent electrolyte taken along with the cathode manganese deposit towards melting step IV is recovered as shown by arrow 9, in recovery step V.

The spent electrolyte which is loaded with ferric and/or ferrous chloride from recovery step V is then directed again to chlorinating step I as shown by arrow 10.

The arrow 11 shows the discharge from purifying step II, of the partly manganese-poor ferromanganese which is however loaded with impurities.

FIG. 2 illustrates in a block-diagram a second embodiment which differs from the first embodiment by a combination of steps III and IV. Such combination occurs in the electrolysis cell proper. According to this embodiment of the invention, the purified electrolyte from step III is fed to cathode compartment C of the electrolysis cell as shown by arrow 4, while the spent ferromanganese and the precipitated iron from step I that comprise the solid phase formed during said first step are fed to anode compartment A without any passage of said solid phase to cathode compartment C. The manganese-poor electrolyte which is loaded again with ferrous and/or ferric chloride and extracted at the electrolysis cell anode is cycled back as shown by arrow 10 to step I.

This embodiment has the advantage relative to the embodiment shown in FIG. 1 of avoiding the problems caused by the conveying of chlorine gas from the electrolysis in step III. In the embodiment shown in FIG. 2, the chlorine is used during the electrolysis proper to regenerate the iron chloride.

Said iron chloride is formed in the anode compartment by reacting the iron from step I either with the chlorine gas formed at the anode or in situ by anodic dissolving.

On the other hand the electrolyte is caused to flow inside the electrolysis cell from cathode compartment A as shown by arrow 12 so as to avoid ferrous and/or ferric chloride contacting the cathode.

FIG. 3 relates to a third embodiment of the method according to the invention which differs from both preceding embodiments by the steps I and V being combined inside the electrolysis cell with step III.

Thus, according to the invention, the liquid phase that contains molten chlorides loaded with manganese chloride and purified from iron chloride in step II is fed to cathode compartment C of the electrolysis cell while ferromanganese is fed as shown by arrow 1 to anode compartment A while preventing the passage of solid particles formed by ferromanganese and precipitated iron into the cathode compartment. The electrolyte that contains manganese chloride and iron chloride formed in the anode compartment is discharged therefrom as shown by arrow 2 and is subjected to the purifying step II by the addition of a fresh amount of ferromanganese as shown by arrow 3 to extract the iron chloride by forming a solid phase containing the precipitated iron and a liquid phase that comprises the phase which can be fed again as shown by arrow 4 to the cathode compartment. Said solid phase containing the impuriites is separated from the liquid phase as shown by arrow 11.

The flow of electrolyte to the cell is performed from the cathode compartment to the anode compartment as shown by arrow 12 so as to take the anolyte out of the cell without same contacting the cathode. Any danger of polluting the cathode deposit with the ferromanganese impurities is thus excluded.

The anolyte is then purified during step II by selective chlorinating of the manganese contained in an excess of ferromanganese.

The ferromanganese used in the method according to the invention is crushed before subjecting same to the chlorinating and may contain from 0.1 to 8% carbon.

The example is illustrative of the method of the invention:

EXAMPLE

Standard carbided ferromanganese, that is, ferromanganese containing about 78% manganese and from 6 to 8% carbon, is so crushed as to have grains with a diameter smaller than 5 mm. This crushed ferromanganese is selectively chlorinated at 600° C during 1 hour in the presence of a molten electrolyte containing initially 20% by weight of ferrous chloride, 30% by weight of NaCl and 50% by weight of $CaCl_2$.

The metallurgy efficiency for the manganese extraction was 95%.

The electrolyte obtained after decanting was subjected at a temperature of 600° C during 10 minutes to a purifying operation with an excess of standard carbided ferromanganese which has been crushed in the same way as described above.

The electrolyte thus purified was subjected to electrolysis.

The cathode manganese deposit gave after melting, a manganese ingot with more than 99.9% manganese, the cathode current efficiency being higher than 90%.

It must be understood that the invention is in no way limited to the above embodiments and that many changes can be made therein without departing from the scope of the invention as defined by the appended claims.

I claim:

1. A method for recovering manganese metal from ferromanganese which comprises:

a. contacting ferromanganese and an iron chloride selected from the group consisting of ferrous chloride and ferric chloride in a molten bath of a metal chloride wherein the metal has a greater chemical affinity for chlorine than iron, to provide a liquid phase containing manganese chloride and a solid phase containing iron precipitate and spent ferromanganese:

b. separating the manganese chloride liquid phase from the iron precipitate and spent ferromanganese;

c. contacting the manganese chloride liquid phase with an additional quantity of ferromanganese to provide a purified liquid phase containing manganese chloride free of iron chlorides and chlorides of metals more noble than manganese;

d. introducing the purified manganese chloride liquid phase into the cathode compartment of an electrolytic cell;

e. introducing the iron precipitate and spent ferromanganese into the anode compartment of the cell;

f. conveying electrolyte from the cathode compartment to the anode compartment of the cell while preventing the iron precipitate and spent ferromanganese from passing from the anode compartment to the cathode compartment of the cell;

g. operating the cell to liberate manganese at the cathode and chlorine at the anode, the chlorine reacting with the iron precipitate and spent ferromanganese to produce iron chloride for contact with ferromanganese.

2. The method of claim 1 in which the ferromanganese is crushed prior to step (a).

3. The method of claim 1 in which the ferromanganese is a carbided ferromanganese containing from about 0.1% to about 8% carbon.

4. The method of claim 1 in which said molten chloride or combination of chlorides has a melting point below about 600° C.

5. The method of claim 1 in which the recovered manganese is separated from any cathodic salts by the melting of said manganese and separation of the molten manganese from the molten cathodic salts.

6. The method of claim 1 in which the molten metal chloride is an alkali metal chloride, alkaline earth metal chloride, or combination thereof, having a melting point below about 700° C.

7. A method for recovering manganese metal from ferromanganese which comprises:

a. contacting ferromanganese and an iron chloride selected from the group consisting of ferrous chloride and ferric chloride in a molten bath of a metal chloride wherein the metal has a greater chemical affinity for chlorine than iron, to provide a liquid phase containing manganese chloride and a solid phase containing iron precipitate and spent ferromanganese;

b. separating the manganese chloride liquid phase from the iron precipitate and spent ferromanganese;

c. introducing the manganese chloride liquid phase into the cathode compartment of an electrolytic cell;

d. introducing ferromanganese into the anode compartment of the cell;

e. conveying electrolyte from the cathode compartment to the anode compartment of the cell while preventing ferromanganese from passing from the anode compartment to the cathode compartment of the cell;

f. operating the cell to liberate manganese at the cathode and chlorine at the anode, the chlorine reacting with the ferromanganese to provide a solid phase containing iron precipitate and spent ferromaganese, and a liquid phase containing manganese chloride, said iron precipitate and spent ferromanganese being prevented from passing from the anode compartment to the cathode compartment of the cell;

g. separating the manganese chloride liquid phase from the iron precipitate and spent ferromanganese present in the anode compartment of the cell;

h. contacting the manganese chloride liquid phase with an additional quantity of ferromanganese to provide a purified liquid phase containing managanese chloride free of iron chlorides and chlorides more noble than manganese; and, i. introducing the purified manganese chloride liquid phase into the cathode compartment of the cell.

8. A method for recovering manganese metal from ferromanganese which comprises:

a. contacting ferromanganese and an iron chloride selected from the group consisting of ferrous chloride and ferric chloride in a molten bath of a metal chloride wherein the metal has a greater chemical affinity for chlorine than iron, to provide a liquid phase containing manganese chloride and a solid phase containing iron precipitate and spent ferromanganese;

b. separating the manganese chloride liquid phase from the iron precipitate and spent ferromanganese;

c. contacting the manganese chloride liquid phase with an additional quantity of ferromanganese to provide a purified liquid phase containing manganese chloride free of iron chlorides and chlorides of metals more noble than manganese;

d. introducing the purified manganese chloride liquid phase into the cathode compartment of an electrolytic cell;

e. introducing ferromanganese into the anode compartment of the cell;

f. conveying electrolyte from the cathode compartment to the anode compartment of the cell while preventing ferromanganese from passing from the anode compartment to the cathode compartment of the cell;

g. operating the cell to liberate manganese at the cathode and chlorine at the anode, the chlorine reacting with the ferromanganese to provide a solid phase containing iron precipitate and spent ferromanganese and a liquid phase containing manganese chloride, said iron precipitate and spent ferromanganese being prevented from passing from the anode compartment to the cathode compartment of the cell;

h. separating the manganese chloride liquid phase from the iron precipitate and spent ferromanganese present in the anode compartment of the cell;

i. contacting the manganese chloride liquid phase with an additional quantity of ferromanganese to provide a purified liquid phase containing manganese chloride free of iron chlorides and chlorides more noble than manganese; and, j. introducing the purified manganese chloride liquid phase into the cathode compartment of the cell.

* * * * *